US005842842A

United States Patent [19]

Callens et al.

[11] Patent Number: 5,842,842

[45] Date of Patent: Dec. 1, 1998

[54] SPIRAL COMPRESSOR HAVING AN OIL CHAMBER IN THE ROTOR

[75] Inventors: Michel Emile Odile Callens, Aartselaar; Jozef Leopold Van der Taelen, Puurs, both of Belgium

[73] Assignee: Atlas Copco Airpower, naamloze vennootschap, Wilrijk, Belgium

[21] Appl. No.: 675,829

[22] Filed: Jul. 5, 1996

[30] Foreign Application Priority Data

Jul. 6, 1995 [BE] Belgium ..... 09500600

[51] Int. Cl.[6] ..... F04C 18/04; F04C 29/02

[52] U.S. Cl. ..... 418/55.2; 418/55.4; 418/55.6; 418/85; 418/101

[58] Field of Search ..... 418/55.2, 55.4, 418/55.6, 85, 91, 101

[56] References Cited

U.S. PATENT DOCUMENTS

| | | | |
|---|---|---|---|
| Re. 33,473 | 12/1990 | Hazaki et al. | 418/55.6 |
| 4,337,984 | 7/1982 | Shaffer | 384/381 |
| 4,795,321 | 1/1989 | Etemad et al. | 418/55.6 |
| 4,818,198 | 4/1989 | Tamura et al. | 418/55.6 |
| 4,898,521 | 2/1990 | Sakurai et al. | 418/55.6 |
| 4,898,522 | 2/1990 | Edelmayer | 418/91 |
| 5,466,134 | 11/1995 | Shaffer et al. | 418/101 |

FOREIGN PATENT DOCUMENTS

| | | | |
|---|---|---|---|
| 5776292 | 5/1982 | Japan | 418/55.6 |
| 4203380 | 7/1992 | Japan | 418/55.6 |
| 63-17265 | 11/1994 | Japan . | |
| 63-41384 | 12/1994 | Japan . | |
| 7600867 | 8/1976 | Netherlands . | |
| 2025530 | 1/1980 | United Kingdom . | |
| 2155549 | 9/1985 | United Kingdom . | |

*Primary Examiner*—John J. Vrablik
*Attorney, Agent, or Firm*—Collier, Shannon, Rill & Scott, PLLC

[57] ABSTRACT

Spiral compressor which contains a housing (1) with the fixed spiral (2); a moving rotor (3) in this housing (1) with the moving spiral (4) working in conjunction with the fixed spiral (2); and a crankshaft (5) containing a main shaft (6) which is bearing-mounted in the housing (1) and which has a secondary shaft (9) situated eccentrically in relation to the geometric axis (11) of the main shaft (6) which is bearing-mounted in the rotor (3) by means of a bearing (14); whereby means (30-31-32) are provided to prevent the rotor (3) from rotating around its own center, such that the rotor (3) can only carry out a circular movement around the geometric axis (11) of the crankshaft (5) as this crankshaft (5) rotates, characterized in that the rotor (3) is provided with an oil chamber (20) which is connected to the bearing (14) between the secondary shaft (9) and the rotor (3).

10 Claims, 1 Drawing Sheet

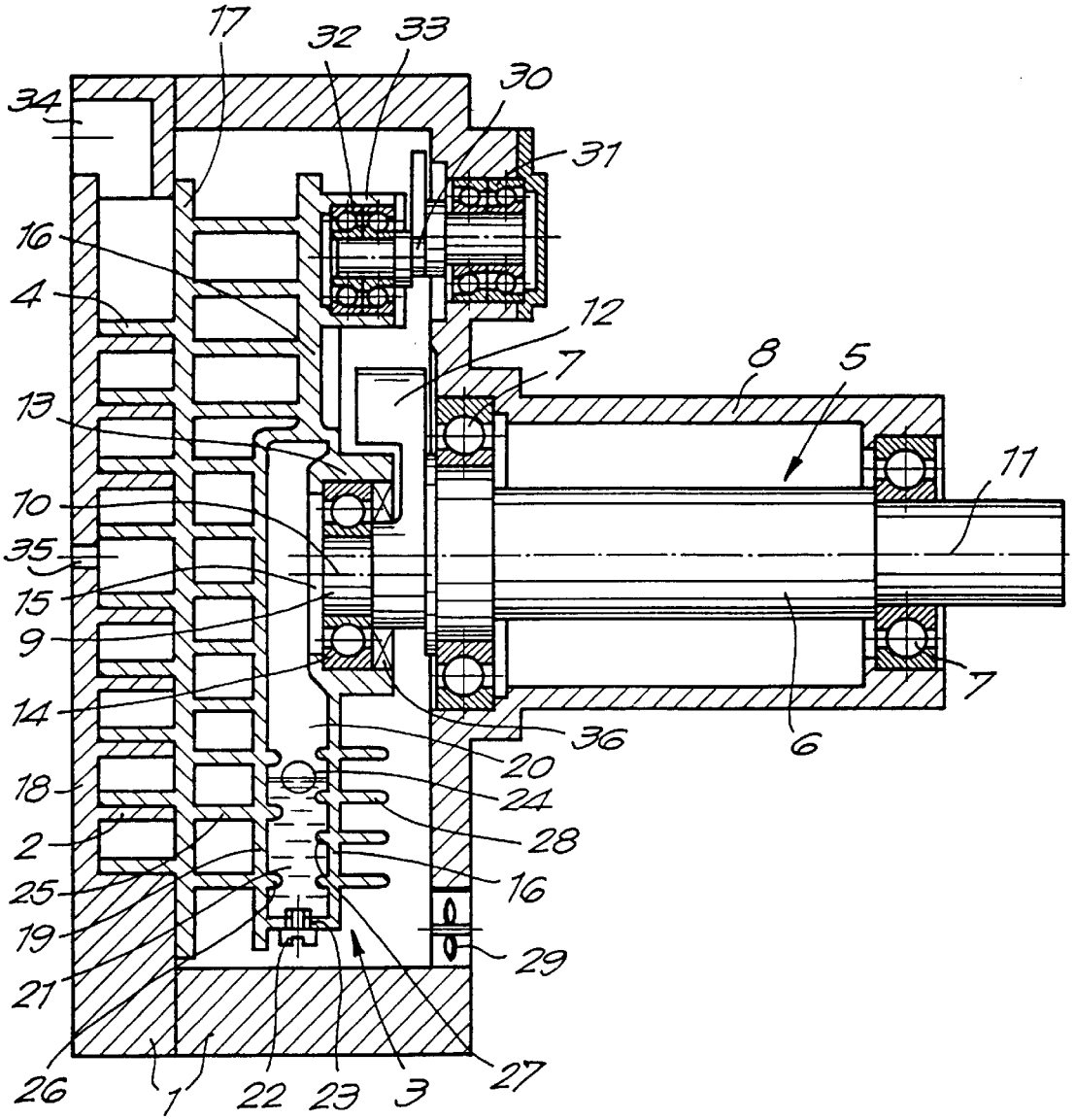
17
32
33
30
34
31
16
4
12
7
8
5
13
11
10
35
15
9
7
14
36
6
20
18
24
2
28
25
16
19
29
21
26
1
22
23
3
27

SPIRAL COMPRESSOR HAVING AN OIL CHAMBER IN THE ROTOR

The present invention concerns a spiral compressor which contains a housing with the fixed spiral; a moving rotor in this housing with the moving spiral working in conjunction with the fixed spiral; and a crankshaft containing a main shaft which is bearing-mounted in the housing and which has a secondary shaft situated eccentrically in relation to the geometric axis of the main shaft which is bearing-mounted in the rotor by means of a bearing; whereby means are provided to prevent the rotor from rotating around its own centre, such that the rotor can only carry out a circular movement around the geometric axis of the crankshaft as this crankshaft rotates.

In such a spiral compressor, the lubrication of the bearing between the secondary shaft and the rotor is extremely important for the life of the compressor.

It is known to lubricate this bearing with grease. However, grease only allows for a limited rotational speed of the rotor and requires maintenance of the compressor at relatively short intervals.

The invention aims a spiral compressor which does not have these and other disadvantages and allows for a higher rotational speed with less maintenance.

This aim is reached according to the invention in that the rotor is provided with an oil chamber which is connected to the bearing between the secondary shaft and the rotor.

Thus, the bearing around the secondary shaft can be lubricated with oil, which does not have the restrictions of grease.

The oil chamber can be partially filled with oil, an amount of which can be slung on the bearing during the circular movement of the rotor.

The oil chamber can be equipped with cooling ribs to cool down the oil.

In order to better explain the characteristics of the invention, the following preferred embodiment of a spiral compressor is described, as an example only without being limitative in any way, with reference to the accompanying drawing which represents a section of a spiral compressor according to the invention.

The figure shows a spiral compressor which mainly consists of a two-part housing 1 with a fixed spiral 2, a moving rotor 3 in this housing with the moving spiral 4 working in conjunction with said fixed spiral, and a crankshaft 5 to drive the rotor 3.

The crankshaft 5 contains a main shaft 6 which is bearing-mounted by means of ball bearings 7 in a part 8 of the housing 1 and a secondary shaft 9 which is connected to one end of the main shaft 6, with its geometric axis 10 parallel to but eccentrically in relation to the geometric axis 11 of the main shaft 6.

For the balance of the crankshaft 5, a counterweight 12 is connected to the main shaft 6, which is opposite eccentric to the secondary shaft 9.

On one side, the rotor 3 is equipped with a collar 13 which is bearing-mounted around the secondary shaft 9 by means of a bearing 14, for example a ball bearing. This collar 13 consists of an opening 15 in the middle of a back wall 16 of the rotor 3.

On the side of the bearing 14 turned away from the opening 15 are provided sealing means 36 inside the collar 13 to seal the bearing 14.

The moving spiral 4 stands on a front wall 17 of the rotor 3 and works in conjunction with the fixed spiral 2 provided on the inner side of a wall 18 which is part of the housing 1.

Between the back wall 16 and the front wall 17 of the rotor 3 is situated a partition wall 19 which connects at the bottom of the rotor 3 and above the opening 15 onto the back wall 16 and together with a part of this back wall 16 forms an oil chamber 20 which extends from under the rotor 3 to above the opening 15 and is thus connected with the bearing 14 via this opening 15.

This oil chamber is partly filled with oil 21 which can be drained via a draining aperture 23 sealed by means of a plug 22 in the bottom of the oil chamber. Filling the oil chamber 20 and checking the oil level therein is done in a known manner via an access 24.

The partition wall 19 and the part of the back wall 16 of the rotor 3 situated above the oil chamber 20 are connected to the front wall 17 by means of ribs 25.

In the oil chamber 20, cooling ribs 26 are provided on the inside of the partition wall 19 and cooling ribs 27 are provided on the inside of the back wall 16. Opposite the cooling ribs 27 are also provided cooling ribs 28 on the outside of the back wall 16.

Cooling air is blown over the back side 16 and thus over the cooling ribs 28 by means of a fan 29. This fan can be mounted externally or, as is represented in the figure, in the housing 1.

To prevent the rotor 3 from rotating around its own centre, one or several crankshafts 30 are mounted between the rotor 3 and the housing 1, which are bearing-mounted with one end in a ball bearing 31 which is worked into the housing 1, and which are bearing-mounted with the other end in a ball bearing 32 which is surrounded by a collar 33 on the back wall 16 of the rotor 3. Three such crankshaft 30 can for example be provided at an angle of 120° in relation to one another.

When the crankshaft 5 is driven by a motor, which is not represented in the figures, the rotor 3, without rotating around its own geometric axis 10, makes a circular movement around the geometric axis 11.

Thanks to this movement, air drawn inside the housing 1 via an inlet 34, provided opposite the addendum line of the fixed spiral 2, is compressed. The compressed air is pressed outside through an outlet 35 provided opposite the centre of the fixed spiral 2 in the housing 1.

During said movement of the rotor 3, the oil 21 is slung around and the required amount is thereby slung on the bearing 14 via the opening 15, so that a good lubrication of this bearing 14 is obtained under all circumstances.

The oil lubrication allows for a higher rotational speed of the rotor 3 than the grease lubrication.

Thanks to the shape of the oil chamber 20 and the connection with the bearing 14, the compressor can cooperate both horizontally with the crankshaft 5 as represented in the figure and vertically with the crankshaft 5. In both cases, the bearing 14 will obtain a sufficient amount of oil.

The invention is by no means limited to the embodiment described above and represented in the accompanying drawings; on the contrary, such a spiral compressor can be made in all sorts of variants while still remaining within the scope of the invention.

We claim:

1. Spiral compressor which contains a housing (1) with a fixed spiral (2); a moving rotor (3) in this housing (1) with a moving spiral (4) working in conjunction with the fixed spiral (2); and a crankshaft (5) containing a main shaft (6) which is bearing-mounted in the housing (1) and which has a secondary shaft (9) situated eccentrically in relation to the geometric axis (11) of the main shaft (6) which is bearing-mounted in the rotor (3) by means of a bearing (14);

whereby means (30-31-32) are provided to prevent the rotor (3) from rotating around its own centre, such that the rotor (3) can only carry out a circular movement around the geometric axis (11) of the crankshaft (5) as this crankshaft (5) rotates, characterized in that the rotor (3) is provided with an oil chamber (20) which is connected to the bearing (14) between the secondary shaft (9) and the rotor (3) and further characterized in that the oil chamber (20) has a draining aperture (23) at the bottom sealed by means of a plug (22).

2. Spiral compressor according to claim 1, characterized in that the oil chamber (20) is partially filled with oil, such that as the rotor moves, an amount is slung on the bearing (14).

3. Spiral compressor according to claim 1, characterized in that it contains a fan (29) for blowing cooled air along the outside of the rotor (3).

4. Spiral compressor according to claim 1, characterized in that the oil chamber (20) is connected to the bearing (14) via an opening (15) provided in the wall of the oil chamber (20) opposite the bearing (14) around the secondary shaft (9).

5. Spiral compressor according to claim 4, characterized in that the oil chamber (20) extends from the bottom of the rotor (3) to above the opening (15).

6. Spiral compressor according to claim 4, characterized in that the rotor (3) has a collar (13) around the opening (15) which surrounds the bearing (14).

7. Spiral compressor according to claim 4, characterized in that on the side of the bearing (14) turned away from the opening (15) are provided sealing means (36) to seal the bearing (14).

8. Spiral compressor which contains a housing (1) with a fixed spiral (2); a moving rotor (3) in this housing (1) with a moving spiral (4) working in conjunction with the fixed spiral (2); and a crankshaft (5) containing a main shaft (6) which is bearing-mounted in the housing (1) and which has a second shaft (9) situated eccentrically in relation to the geometric axis (11) of the main shaft (6) which is bearing-mounted in the rotor (3) by means of a bearing (14): whereby means (30-31-32) are provided to prevent the rotor (3) from rotating around its own centre, such that the rotor (3) can only carry out a circular movement around the geometric axis (11) of the crankshaft (5) as this crankshaft (5) rotates, characterized in that the rotor (3) is provided with an oil chamber (20) which is connected to the bearing (14) between the secondary shaft (9) and the rotor (3), and, further characterized in that the oil chamber (20) is equipped with cooling ribs (20).

9. Spiral compressor according to claim 8, characterized in that cooling ribs are provided on the inside of the oil chamber (20).

10. Spiral compressor according to claim 8, characterized in that cooling ribs are provided on the outside of the oil chamber (20).

* * * * *